US005678119A

United States Patent [19]

Tamaki

[11] Patent Number: 5,678,119

[45] Date of Patent: Oct. 14, 1997

[54] APPARATUS FOR TRANSPORTING PHOTOGRAPHIC PHOTOSENSITIVE MATERIAL

[75] Inventor: Yoshikazu Tamaki, Wakayama, Japan

[73] Assignee: Noritsu Koki Co., Ltd., Wakayama, Japan

[21] Appl. No.: 628,104

[22] Filed: Apr. 9, 1996

[30] Foreign Application Priority Data

Apr. 12, 1995 [JP] Japan ..... 7-110323
Nov. 10, 1995 [JP] Japan ..... 7-315791

[51] Int. Cl.[6] ..... G03D 3/08

[52] U.S. Cl. ..... 396/618; 396/620

[58] Field of Search ..... 354/319–324, 354/308–313, 316, 317, 339; 226/88, 172, 173, 198, 190, 196, 171, 119; 271/272, 273–275, 198–203, 280–286; 355/27–29; 198/806, 814; 134/64 P, 64 R, 122 P, 122 R

[56] References Cited

U.S. PATENT DOCUMENTS

| | | | |
|---|---|---|---|
| 2,869,865 | 1/1959 | Lechner | 226/173 |
| 2,899,201 | 8/1959 | Pirot | 271/272 |
| 2,927,503 | 3/1960 | Zollinger | 354/321 |
| 4,170,175 | 10/1979 | Conlon, Jr. | 226/198 |
| 4,181,421 | 1/1980 | Kitrosser | 354/321 |
| 4,302,002 | 11/1981 | Hashimoto | 271/272 |
| 4,527,686 | 7/1985 | Satoh | 198/807 |
| 5,281,989 | 1/1994 | Sitte | 354/320 |
| 5,396,308 | 3/1995 | Shimamoto et al. | 354/319 |

*Primary Examiner*—D. Rutledge
*Attorney, Agent, or Firm*—Oblon, Spivak, McClelland, Maier & Neustadt, P.C.

[57] ABSTRACT

An apparatus for transporting a photographic photosensitive material in an automatic developing apparatus has a direction-changing transporting section. The direction-changing transporting section includes a rotating center roller, at least three auxiliary rollers disposed around the center roller, and a transporting belt which is looped around the at least three rollers to travel while contacting a substantially lower half of the center roller. The direction-changing transporting section is used, for example, in a section for processing a photographic photosensitive material in solutions. The transporting belt has a guide protrusion along each side edge thereof, and the auxiliary rollers have a smaller-diameter portion at each end portion thereof for engaging with each of the guide protrusions. Thus, a stable force is obtained for transporting the photographic photosensitive material. By employing the structure described above, high-quality photographs are provided.

2 Claims, 5 Drawing Sheets

APPARATUS FOR TRANSPORTING PHOTOGRAPHIC PHOTOSENSITIVE MATERIAL

BACKGROUND OF THE INVENTION

1. Field of the Invention

The present invention relates to an apparatus for transporting sheets of photographic photosensitive material. More particularly, the present invention relates to an apparatus for transporting sheets of photographic photosensitive material with an improved direction-changing transporting section used for processing sheets of photographic photosensitive material in solutions.

2. Description of the Related Art

An automatic developing apparatus is designed such that a photographic photosensitive material is sequentially transported by a transporting apparatus through an exposure section, processing solution baths, a drying section, etc., thereby completing a developing and a finishing. In the transporting apparatus, a transporting path is formed by rollers, transporting belts, guides, etc. A photographic photosensitive material is transported on rollers and transporting belts by rotation of the rollers and the like. In some case, a photographic photosensitive material is held between a pair of rollers or between a transporting belt and a roller and transported by rotation of the rollers or the like.

There are two types of automatic developing apparatus. In a first type of automatic developing apparatus, a photographic photosensitive material is cut into sheets having a size corresponding to a frame, and the sheets of photographic photosensitive material are transported and undergo fine adjustment of each frame during exposure, developing, etc. In a second type of automatic developing apparatus, a photographic photosensitive material is cut into a long size corresponding to each film length or to an ordered processing unit, and after processing in solutions is completed, the long-sized photographic photosensitive material is cut into pieces, each having the size of a frame. Each of these automatic developing apparatus has a transporting apparatus suited for the form of a photographic photosensitive material to be processed.

In the type for transporting a long-sized photographic photosensitive material, rollers and transporting belts producing a transporting force are disposed apart from each other, and guides are disposed therebetween, thereby forming a transporting path. In this case, changing direction of transport to that perpendicular to a photographic photosensitive material is considerably restricted.

In the type for transporting sheets of photographic photosensitive material, many rollers and transporting belts producing a transporting force are required, but changing direction of transport is not considerably restricted.

A path of transporting a photographic photosensitive material depends on the form of transporting a photographic photosensitive material and arrangement of rollers and transporting belts. Usually, the transporting path is not straight, but meanders by changing direction of transport as needed, thereby obtaining a long transporting path within a small sized apparatus and small sized processing solution baths. A function of changing direction of transport is provided in a transporting apparatus and is carried out by a direction-changing transporting section. FIGS. 1 and 2 show direction-changing transporting sections of conventional apparatus for transporting a photographic photosensitive material.

In a direction-changing transporting section shown in FIG. 1, three side rollers 32, 34, and 36 contact a center roller 31, and each of guides 33 and 35 is interposed between the side rollers. As shown in FIG. 1, a photosensitive material 37 is held between the center roller 31 and the side roller 32 and fed into the direction-changing transporting section. Then, the direction of the photosensitive material 37 is changed by the guide 33. After that, the photosensitive material 37 is held between the center roller 31 and the side roller 34 and fed further to reach the guide 35, where the direction of the photosensitive material 37 is again changed. Thus, the photosensitive material 37 is ejected in a direction opposite to that of entry.

In a direction-changing transporting section shown in FIG. 2, five side rollers 42, 43, 44, 45, and 46 are disposed around a center roller 41. The direction-changing transporting section of FIG. 2 is different from that of FIG. 1 in that there is a spacing between the center roller 41 and each side roller. When a photosensitive material 47 enters the direction-changing transporting section, the fore end of the photosensitive material 47 contacts the side roller 43 and is caused to change its direction of advancement. The photosensitive material 47 is transported by the side roller 42 and then is caused by the side roller 44 to change its direction of advancement. Thus, the photosensitive material 47 contacts each side roller and is caused to change gradually its direction of advancement, and is finally ejected in a direction opposite to that of entry.

In order to prevent a photographic photosensitive material from being damaged while it is transported within an automatic developing apparatus, a transporting apparatus is devised in various ways. For example, rollers, guides, and transporting belts of the transporting apparatus are usually made of smooth soft materials. When a photographic photosensitive material is to be nipped between rollers or the like, an appropriate nipping pressure is selected in accordance with the materials used.

Cutting dust or the like attracted to a photographic photosensitive material may hinder a processing solution from penetrating into the photographic photosensitive material or may damage the photographic photosensitive material being transported. According to a sheet transporting apparatus disclosed in Japanese Patent Application Laid-Open (kokai) No. 6-278893, an electrically conductive urethane rubber belt and an electrically conductive nickel drum are used to transport a photographic photosensitive material so that no static electricity is generated in rollers, guides, and the photographic photosensitive material.

While a photographic photosensitive material is transported through processing solutions, a processing solution tends to permeate a cut end of the photographic photosensitive material, causing the cut end to fissure or blister. When a photographic photosensitive material is cut into sheets corresponding to frames with resultant handling of many cut ends, a problem of a fissuring or blistering is more likely to occur, resulting in an increased potential degradation in quality of photographs.

According to a method of processing print paper disclosed in Japanese Patent Publication (kokoku) No. 6-19543, print paper is cut into a long size corresponding to each film length or to an ordered processing unit while a leader portion is left at a cut end portion. This process is called primary cutting, and thus cut long-sized print paper undergoes developing. The developed long-sized print paper is then cut into a size corresponding to each frame; this process is called secondary cutting. Specifically, print paper undergoes printing frame by frame over a length corresponding to a processing unit while a leader portion extending a predetermined length from a fore cut end of the print paper is left unprinted. Then, primary cutting is performed at the end of the processing unit. The thus printed and cut print paper of the processing unit undergoes developing. The developed print paper undergoes secondary cutting at a position of each cut mark which is previously marked between frames and between the leader portion and a frame.

A fore cut end, where a processing solution tends to permeate, is cut off and thrown away as a leader portion. Hence, the method of processing print paper disclosed in Japanese Patent Publication (kokoku) No. 6-19543 provides photographs having good quality which are not degraded by fissuring or blistering caused by permeation of a processing solution into print paper.

As described above, an apparatus for transporting a photographic photosensitive material has a structure in accordance with specifications of an automatic developing apparatus. Also, an apparatus for transporting a photographic photosensitive material is devised so as to transport the photographic photosensitive material for appropriate developing and so as not to damage the material for obtaining photographs with higher quality.

Recently, an automatic developing apparatus is required to be reduced in size and to have further improved processing capability. An automatic developing apparatus having a higher processing capability naturally has a longer processing path and more rollers for transporting a photographic photosensitive material. In order to reduce the size of an automatic developing apparatus while a processing capability is held unchanged, it is necessary to make a transporting path meander by frequently changing direction of transport to thereby compactly integrate the transporting path and other members. This increases the number of direction-changing transporting sections.

In either case described above, the frequency of contact of a photographic photosensitive material with rollers, guides, etc. increases. Since many rollers are used and a photographic photosensitive material is deformed elastically so as to change its direction of transport, the direction-changing transporting section of a conventional apparatus for transporting a photographic photosensitive material tends to cause the generation of dust and damage to a cut end of the material.

When cutting dust or the like adheres to the image side of a photographic photosensitive material and to rollers in processing solution baths, a proper processing by solutions is hindered, or scratches on the image side may occur, resulting in degraded quality of photographs. When a damaged cut end portion repeatedly undergoes nipping between rollers and release from nipping, a processing solution is more likely to permeate the cut end portion. As a result, the cut end portion fissures or blisters, resulting in degraded quality of a photographic photosensitive material.

The sheet transporting apparatus disclosed in Japanese Patent Application Laid-Open (kokai) No. 6-278893 uses an electrically conductive urethane rubber belt and an electrically conductive nickel drum, so that it is possible to prevent static electricity from being generated in transporting rollers and in a photographic photosensitive material. However, the adhesion of dust or the like cannot be prevented. It is therefore necessary to take measures to minimize the generation of dust or the like.

According to the method for processing print paper disclosed in Japanese Patent Publication (kokoku) No. 6-19543, a leader portion follows a cut end which a processing solution tends to permeate and is cut off during a finishing step so as to maintain a certain quality level. However, an additional operation is required to collect cut leader portions, and extra photographic photosensitive material is required for leader portions, resulting in higher cost. Since photographic photosensitive materials and development service are provided for considerably low prices, a reduction of cost is important.

SUMMARY OF THE INVENTION

An object of the present invention is to provide, for use in an automatic developing apparatus, an apparatus for transporting a photographic photosensitive material with a direction-changing transporting section which hardly damages the photographic photosensitive material, thereby providing high-quality photographs at lower cost.

To achieve the above-described object, the present invention provides an apparatus for transporting a photographic photosensitive material including a direction-changing transporting section. The direction-changing transporting section is composed of a rotating center roller, at least three auxiliary rollers disposed around the center roller, and a transporting belt which is looped around the at least three rollers to travel while contacting a substantially lower half of the center roller. Since a photographic photosensitive material is transported while being held between the center roller and the transporting belt, an appropriate nipping force is applied to the photographic photosensitive material. It is therefore possible to change direction of transport of the photographic photosensitive material without damaging the material.

Preferably, the transporting belt has a guide protrusion along each side edge thereof, and the auxiliary rollers have a smaller-diameter portion at each end portion thereof for engaging with each of the guide protrusions. Accordingly, it is possible to obtain a stable force of transporting the photographic photosensitive material and to prevent the transporting belt from meandering or coming off the auxiliary rollers.

Since a force of nipping a photographic photosensitive material is reduced to a minimum level required for maintaining smooth transport of the material, a cut end, most likely to be damaged, of the photographic photosensitive material is protected, and dust is less likely to be generated. When the apparatus for transporting a photographic photosensitive material of the present invention is used in a developing section, a processing solution is less likely to permeate a cut end of the photographic photosensitive material because the material is transported while being nipped by an appropriate nipping force, whereby the cut end does not blister or fissure. Since dust is less likely to be generated, a problem is solved that dust adhering to transporting rollers hinders permeation of a processing solution into the photographic photosensitive material or scratches the surface of the material. Thus, photographs with stable quality are obtained. Because of a structure that a center roller is combined with auxiliary rollers around which a transporting belt is looped, fewer components are used, resulting in reduced cost.

BRIEF DESCRIPTION OF THE DRAWINGS

Various other objects, features and many of the attendant advantages of the present invention will be readily appreciated as the same becomes better understood by referring to the following detailed description of the preferred embodiments when considered in connection with the accompanying drawings, in which.

DETAILED DESCRIPTION OF THE PREFERRED EMBODIMENTS

Figure 1:
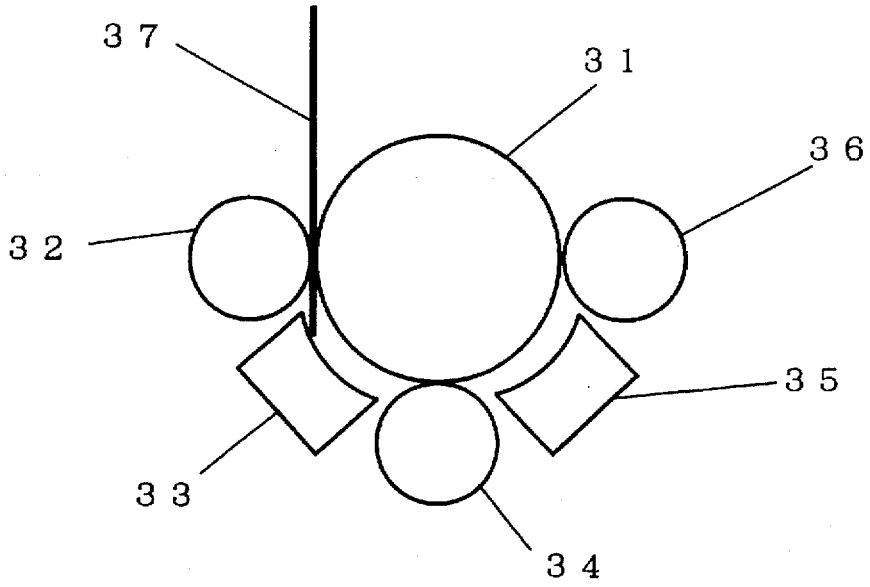
FIG. 1 (PRIOR ART)
FIG. 1 is a schematic cross-sectional view showing a direction-changing section of a conventional apparatus for transporting a photographic photosensitive material.
Figure 2:
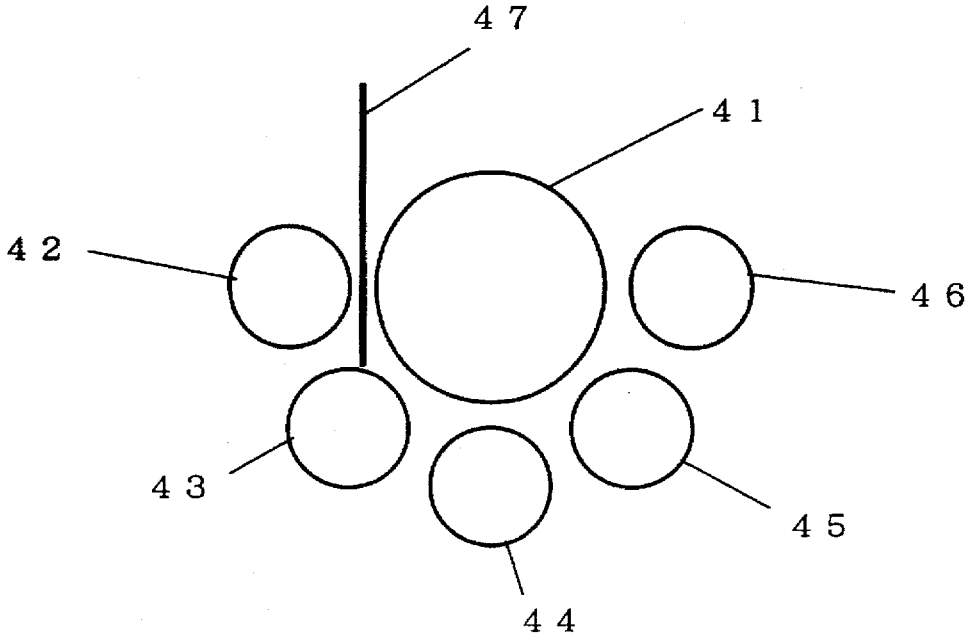
FIG. 2 (PRIOR ART)
FIG. 2 is a schematic cross-sectional view showing a direction-changing section of another conventional apparatus for transporting a photographic photosensitive material.
Figure 3:
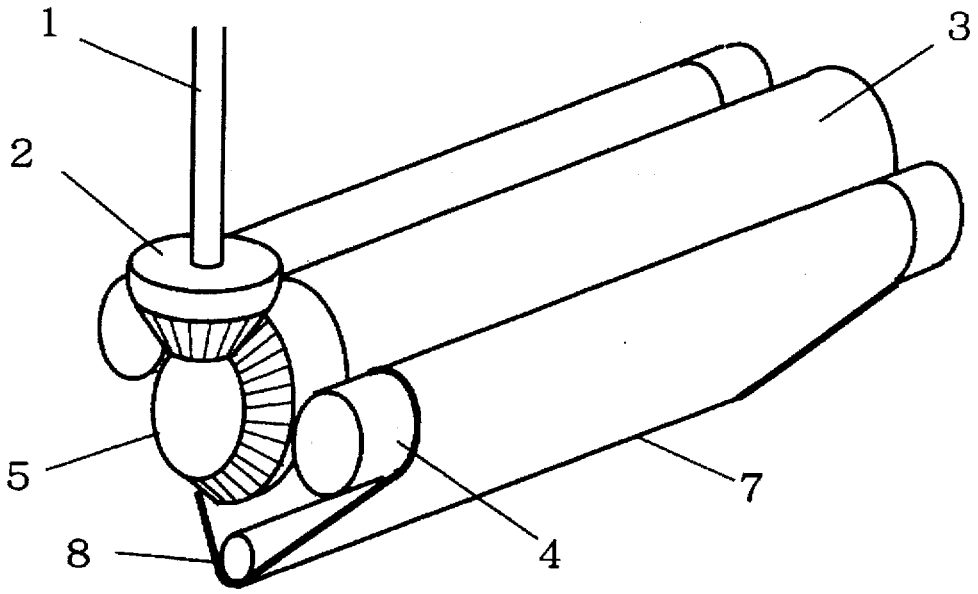
FIG. 3 is a schematic perspective view showing an apparatus for transporting a photographic photosensitive material according to an embodiment of the present invention.

Embodiments of the present invention will now be described with reference to the accompanying drawings. FIG. 3 shows an apparatus for transporting a photographic photosensitive material according to an embodiment of the present invention. Power is transmitted from a drive power source (not shown) to a drive shaft 1. Power transmitted to the drive shaft 1 is transmitted to a center roller 3 via a bevel gear 2 and a gear 5 to rotate the center roller 3. A transporting belt 7 is looped around three auxiliary rollers, i.e. two belt rollers 4 and a tension roller 8 while the transporting belt 7 contacts the center roller 3 such that it covers the lower half of the center roller 3.

Figure 4:
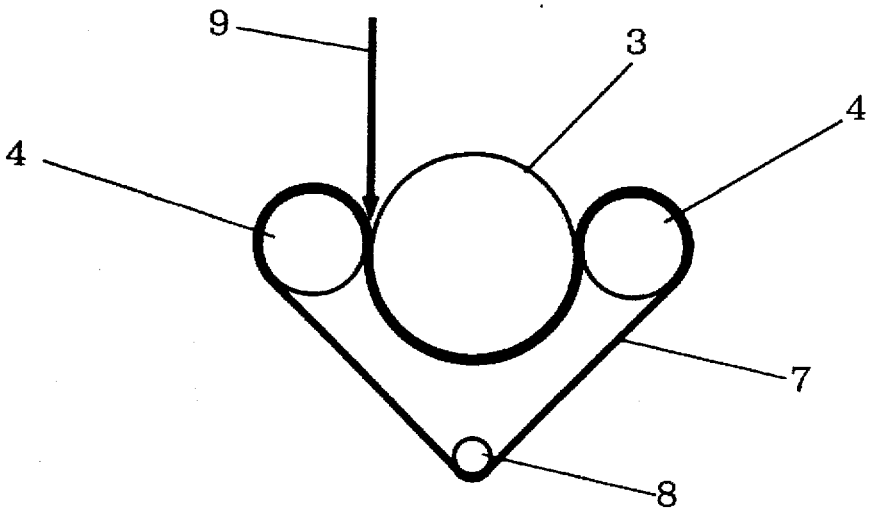
FIG. 4 is a schematic cross-sectional view of the transporting apparatus of FIG. 3.

As shown in FIG. 4, the transporting belt 7 is pressed against the center roller 3 such that the center roller 3 sinks in the transporting belt 7. A photosensitive material 9 entering between the center roller 3 and the transporting belt 7 is held therebetween and transported while changing its direction of transport, and finally ejected in a direction opposite to that of entry.

Figure 5:
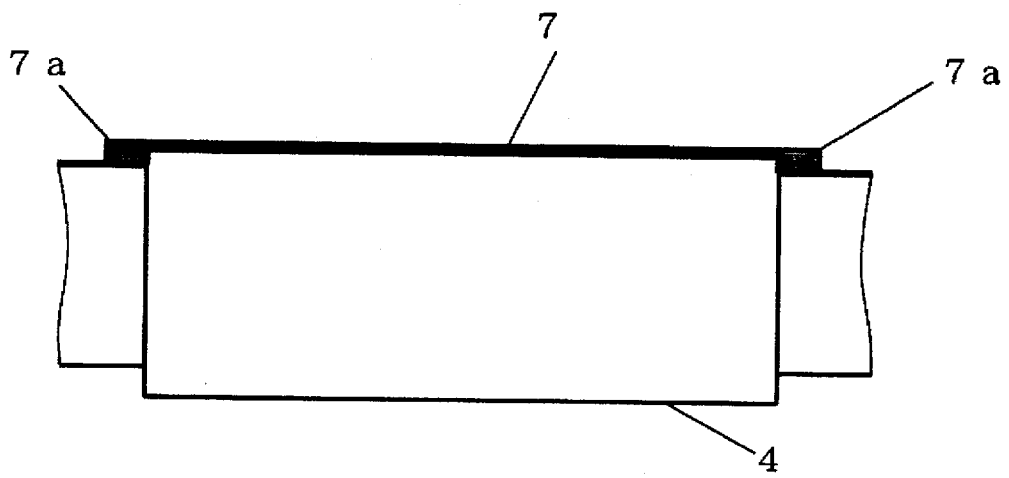
FIG. 5 is a schematic side view of the transporting apparatus of FIG. 4.

As shown in FIG. 5, the belt roller 4 has a smaller-diameter portion at each end thereof. A guide protrusion 7*a* provided on the transporting belt 7 engages each smaller-diameter portion, thereby preventing the transporting belt 7 meandering or coming off the belt rollers 4. In addition to the belt rollers 4, a tension roller or the like also has a smaller-diameter portion at each end thereof, allowing the guide protrusions 7*a* to engage the respective smaller-diameter portions.

Figure 6:
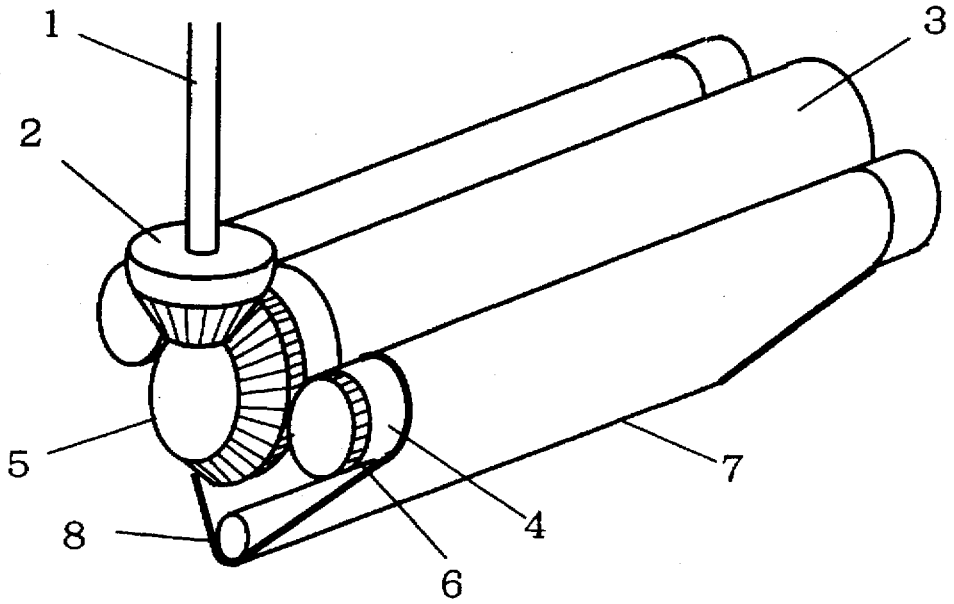
FIG. 6 is a schematic perspective view showing an apparatus for transporting a photographic photosensitive material according to another embodiment of the present invention.

FIG. 6 shows an apparatus for transporting a photographic photosensitive material according to another embodiment of the present invention. Power is transmitted from a drive power source (not shown) to the drive shaft 1. Power transmitted to the drive shaft 1 is transmitted to the center roller 3 and a belt roller 4 via the bevel gear 2, the gear 5, and a gear 6 to rotate the center roller 3 and the belt roller 4.

The present invention is not particularly limited to the above embodiments. A transporting belt may be a timing belt, a mesh belt, a fabric belt, a flat belt, etc. A belt roller may be toothed or center-bulged. An appropriate combination of a transporting belt and belt rollers may be selected in accordance with an actual application. For example, when a timing belt is combined with a toothed roller, a rotational force of the roller is reliably transmitted to the belt. When a mesh belt is used in a processing solution bath, a processing solution readily permeates a photosensitive material and reliably drains away. When a fabric belt is used, a cushioning property can be expected therefrom.

Available materials for a transporting belt and a belt roller include silicone rubber, polypropylene, polyvinyl chloride, polyphenylene oxide, polyethylene, and epoxy resin, and materials may be selected in accordance with an actual application. For example, an application in a processing solution bath requires materials which is not deteriorated by absorbed solution, is resistant to acids and alkalis, and is not affected by components of a processing solution. In s place where cutting dust or the like tends to float, an electrically conductive material may be used for an endless belt to prevent generation of static electricity. An example of such endless belt is an SE belt of Nitta Co., Ltd. in which a polyester endless core cloth is coated with MPU (MIRABL urethane), NBR (NITRI rubber), or CR (chloroprene rubber).

If a transporting belt is too tense, the transporting belt is pressed against the center roller too tight, resulting in damage to a photosensitive material. If the transporting belt is too loose, an appropriate transporting force is not obtained for smooth transport of a photosensitive material, resulting in a stagnant photosensitive material. Further, an idling roller may rub the photosensitive material, or the transporting belt may come off, causing the photosensitive material to get stuck. Tension of a transporting belt depends on elasticity of a photosensitive material, but is preferably 10–20 g/cm.

At least three belt and tension rollers are required for stable support and drive of the transporting belt. The embodiments use two belt rollers for driving a transporting belt and one tension roller. However, four belt and tension rollers may be combined as needed.

The apparatus for transporting a photographic photosensitive material of the present invention is most suited for use in the vicinity of a processing solution bath, where a photographic photosensitive material softens due to absorbed solution and hence is likely to be damaged. However, the apparatus may be used in other places including an exposure section and a drying section.

Figure 7:
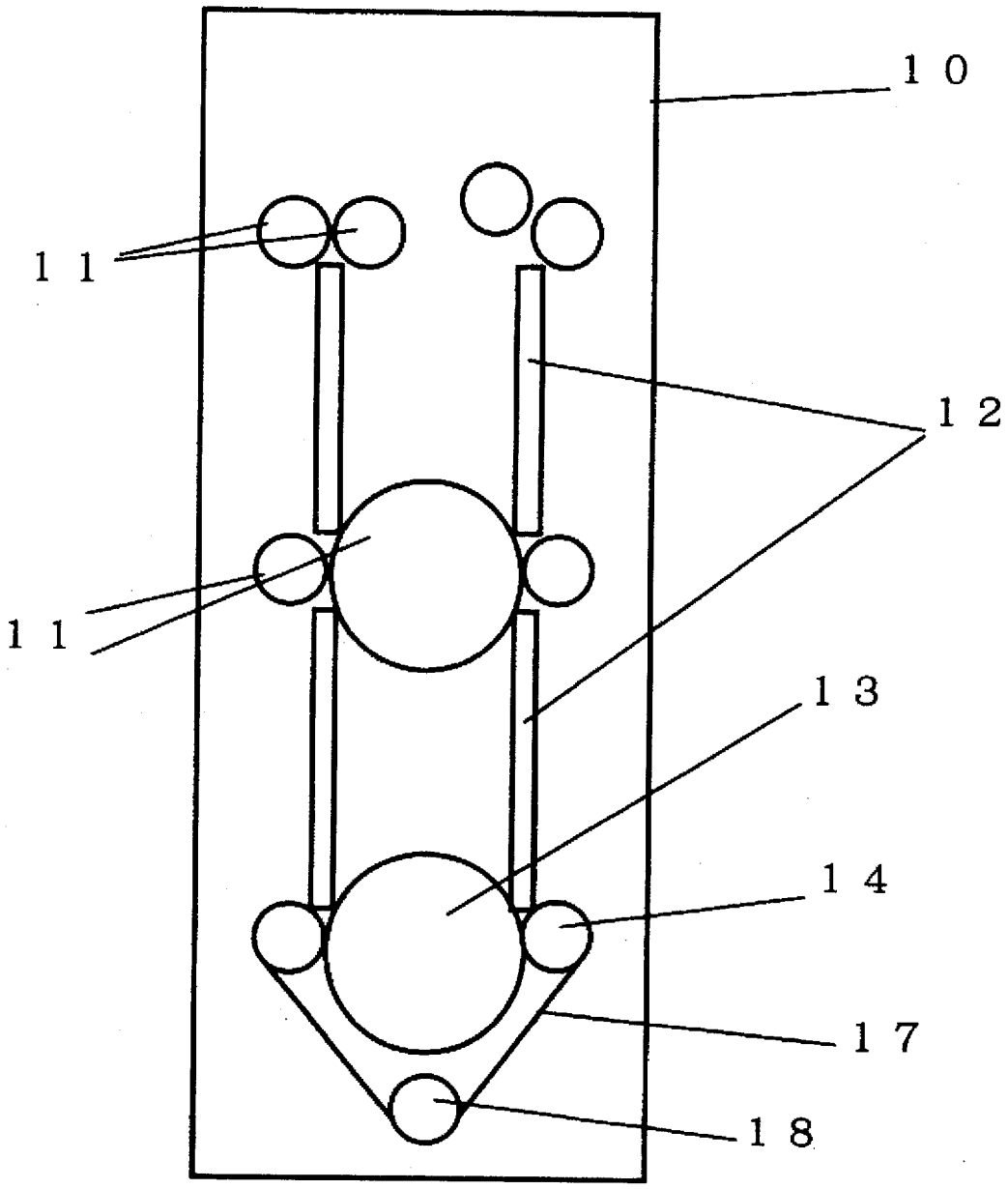
FIG. 7 is a schematic cross-sectional view showing a transporting rack using the apparatus for transporting a photographic photosensitive material of the present invention.

FIG. 7 shows a transporting rack using the apparatus for transporting a photographic photosensitive material of the present invention. A transporting rack 10 contains transporting rollers 11, guides 12, etc. The transporting rollers 11 and the guides 12 are disposed in a straight transporting path. A direction-changing transporting section is located at the lower portion of the transporting rack 10 and uses a center roller 13 and a transporting belt 17. The transporting belt 17 is looped around a tension roller 18 and belt rollers 14 and rotated in the same direction as the rotating direction of the center roller 13.

Figure 8:
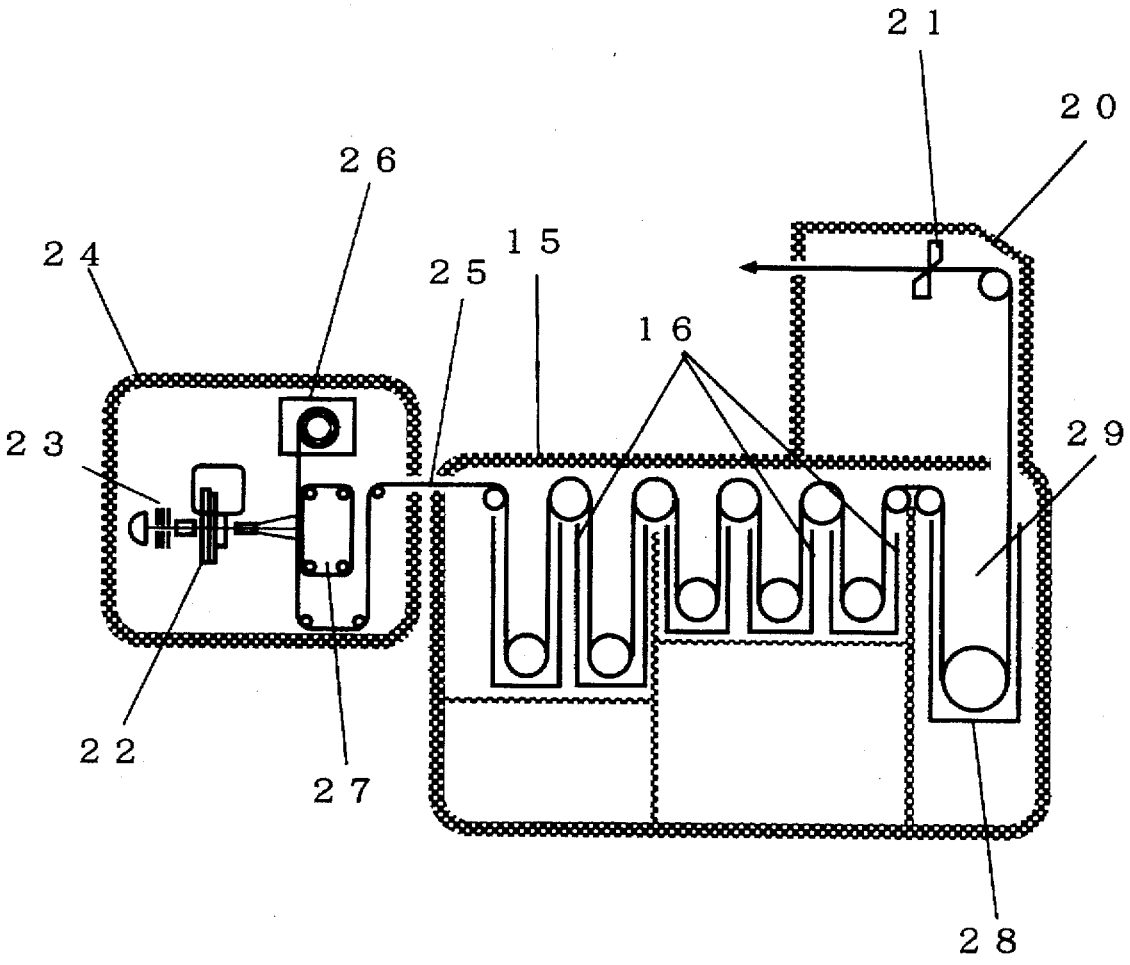
FIG. 8 is a schematic cross-sectional view showing a photosensitive material processing apparatus using the apparatus for transporting a photographic photosensitive material of the present invention.

FIG. 8 is a photosensitive material processing apparatus using the apparatus for transporting a photographic photosensitive material of the present invention. The photosensitive material processing apparatus is composed primarily of a printing section 24, a developing section 15, a drying section 29, and a cutter section 20. The transporting rack of FIG. 7 is used in the developing section 15.

The printing section 24 is shielded from light and has an exposure means 23 for exposing a film 22 to light emitted from a light source or the like, an exposure stand 27, and a magazine 26 housing a print paper roll. The photosensitive material processing apparatus performs exposure and development on print paper 25 which is transported in the form of continuous paper. Exposed print paper advances to the developing section 15 and is sequentially transported through processing solution baths for development. The developing section 15 has submerged racks 16, each of which may use the transporting rack of FIG. 7.

The print paper from the developing section 15 is transported to the drying section 29. The transporting rack of FIG. 7 may be used as a drying rack 28 provided in the drying section 29. The dried print paper is transported to the cutter section 20. The print paper is cut by a cutter 21 into pieces corresponding to frames, thereby providing photographic prints.

The apparatus for transporting a photographic photosensitive material of the present invention can also be used in a processing apparatus handling sheets of print paper as well as a processing apparatus handling continuous print paper described above. The present invention is not limited to the above embodiments, but may be applicable to a transporting apparatus not using a transporting rack and to a direction-changing transporting section in other than developing and drying sections.

What is claimed is:

1. An apparatus for transporting a photographic photosensitive material in an automatic developing apparatus, comprising a direction-changing transporting section which comprises:

a rotating center roller;

at least three auxiliary rollers disposed around said center roller;

a transporting belt which is looped around said at least three rollers to travel while contacting a substantially lower half of said center roller;

said transporting belt has a guide protrusion along each side edge thereof; and said auxiliary rollers have a smaller-diameter portion at each end portion thereof for engaging with each of the guide protrusions.

2. An apparatus for transporting a photographic photosensitive material according to claim 1, wherein a tension of 10–20 g/cm is applied to said transporting belt.

* * * * *